US005931410A

United States Patent [19]

Feierlein et al.

[11] Patent Number: 5,931,410

[45] Date of Patent: Aug. 3, 1999

[54] SYSTEM FOR GUIDING THE END PHASE OF GUIDED AUTONOMOUS MISSILES

[75] Inventors: Johannes Feierlein, Oberpframmern; Albrecht von Mueller, Berg, both of Germany

[73] Assignee: Daimler-Benz Aerospace AG, Munich, Germany

[21] Appl. No.: 08/990,722

[22] Filed: Dec. 15, 1997

[30] Foreign Application Priority Data

Dec. 13, 1996 [DD] German Dem. Rep. ..... 196 51 888

[51] Int. Cl.[6] ..... F41G 7/00; F42B 22/00; F42C 22/02

[52] U.S. Cl. ..... 244/3.19; 102/401; 102/427

[58] Field of Search ..... 244/3.19, 3.15, 244/3.16; 102/401, 427, 409; 89/1.11

[56] References Cited

U.S. PATENT DOCUMENTS

| | | | |
|---|---|---|---|
| 4,281,809 | 8/1981 | Oglesby et al. | 244/3.16 |
| 4,375,168 | 3/1983 | Swenson et al. | 102/427 |
| 4,540,139 | 9/1985 | Levy et al. | 244/3.19 |
| 4,867,034 | 9/1989 | Trosky et al. | 244/3.15 |
| 4,997,144 | 3/1991 | Wolff et al. | 244/3.19 |
| 5,118,050 | 6/1992 | Arnold et al. | 244/3.19 |
| 5,131,602 | 7/1992 | Linick | 244/3.19 |
| 5,458,041 | 10/1995 | Sun et al. | 244/3.19 |

FOREIGN PATENT DOCUMENTS 37 05 383 9/1988 Germany .

*Primary Examiner*—Charles T. Jordan
*Assistant Examiner*—Theresa M. Wesson
*Attorney, Agent, or Firm*—Evenson, McKeown, Edwards & Lenahan, P.L.L.C.

[57] ABSTRACT

A system for guiding the end phase of guided autonomous missiles consists of a marker unit having a sensor, a signature transmitter and a device for attachment to the target, as well as a cooperating direction finder in the guided missile.

8 Claims, 1 Drawing Sheet

SYSTEM FOR GUIDING THE END PHASE OF GUIDED AUTONOMOUS MISSILES

BACKGROUND AND SUMMARY OF THE INVENTION

The invention relates to a system for guiding the end phase of autonomous guided missiles, i.e., self-guided missiles, which operate according to the "lock-after-launch" principle. The system uses target signatures of a marker emitter for the target recognition and the missile guiding. The components for the target recognition and the flight guidance are separated from one another as a transmitter at the target and a receiver at the missile.

In the previous state of the art, when guided autonomous long-range guided missiles (LFK) are used, the target acquisition or the target assignment takes place after the start of the launch; as known, for example from German Patent document DE 37 05 383 which relates to a system for guiding the end phase of self-guided missiles. However, during the launching, a considerable risk exists as to whether a target will be found at all; whether it will then be detected, and whether it will be assigned to the homing search head. For this reason, in the case of such missions, as a rule, several guided missiles are used simultaneously and against several targets to improve the success rate.

However, also in these cases, the rate of success is considerably lower than, for example, in the case of command-guided or preliminary precision-approach guided missiles. Furthermore, the homing head, which, as a rule, is a sensor which is sensitive in several spectral ranges, must be able to detect the target at a relatively large distance, differentiate it from non-targets, and finally track it, represents a very high-quality and expensive instrument.

There is therefore needed a system of the above-mentioned type which is both significantly optimized in its efficiency and also in its economy.

These needs are met according to the present invention by a system for guiding the end phase of guided autonomous long-range guided missiles (LFK). The system uses target signatures of a marker emitter for the target recognition and the missile guiding. The components for the target recognition and the flight guidance are separated from one another as a transmitter at the target and a receiver at the missile. The markers carrying the signature sensor or sensors are placed or dropped in large quantities in an area to be blocked off. The signature sensor(s) is activated only by the targets to be combatted. The first continuous radio signals of the position transmitter, with its antenna arrangement, start the guided missiles toward the target in a rough alignment. The markers simultaneously by means of an acceleration device, move toward the target, and lock there by means of an attaching device, thus maintaining radio communication with the direction finder of the guided missile until the target is struck.

Advantageously, the markers are provided with several different signature sensors and the signatures of the sensors are used individually or can be combined with one another. It is especially useful for commercially available magnetic-field sensors, temperature sensors or acoustic sensors to be used as the signature sensors.

Also advantageously, the antenna of the direction finder can be composed of three individual antennas situated at an acute angle with respect to one another. Further advantageous features according to the present invention make use of permanent magnets as the attaching device and pyrotechnical propellants for the acceleration device.

Other objects, advantages and novel features of the present invention will become apparent from the following detailed description of the invention when considered in conjunction with the accompanying drawings.

DETAILED DESCRIPTION OF THE DRAWINGS

The basic idea of the invention provides for the discovery task and discrimination task to be carried out by a simple inexpensive sensor—which operates in the close range—, in which case this sensor also attaches itself to the target object and, as a result, marks its position and moving direction as well as establishes a communication connection with the guided missile which ensures the guiding of the guided missile into the target.

Figure 1:
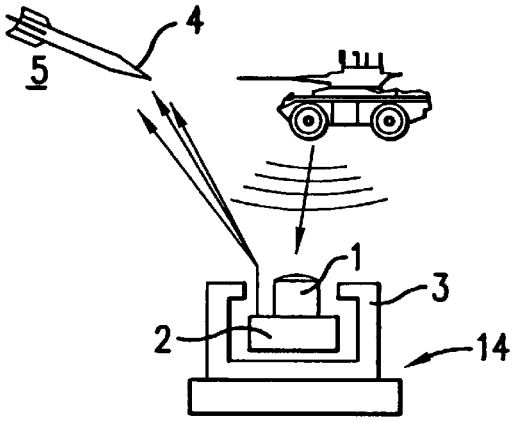
FIG. 1 is an overall representation of the method of operation of an embodiment of the invention when in use.

A preferred embodiment—which is illustrated in FIG. 1—has the following components:

a) A sensor 1 which, in the close range, that is, within the lethal radius of the guided missile 5 used for combatting the target, identifies a target because of the unambiguous signatures existing there. It is known that special signatures exist in the direct or close range of military targets, as, for example, its magnetic field or its heat signature of the propulsion system or of the exhaust system, particularly, however, the acoustic signature. All of these signatures are relatively easy to detect and can clearly be assigned to the target type. These signatures can be used individually or can be combined. Since these are commercially available individual sensors for the close range, the economy of the system is considerably optimized.

b) The next component of the system is formed by a marker transmitter 2 which, after the identification of a target by the sensor 1, emits a radio signal as long as the sensor clearly senses the target signatures. Preferably, this signal should be difficult to detect and interfere with by the enemy side. Since this transmitter must be operable only for a limited time—from the detection of the target to the end of the combatting operation—a battery is sufficient for supplying the current. The radio signal is emitted all around by way of a simple antenna arrangement, in which case the range is larger than or equal to the distance which must at least be covered by the guided missile 5 after the target detection in order to securely hit the target, thus in the final or "end" guided phase.

Figure 4:
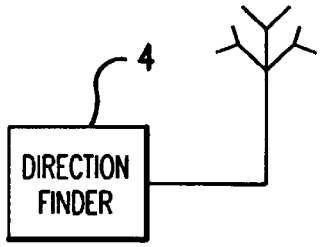
FIG. 4 is a schematic diagram of the direction finder and antenna system.

The above components 1, 2 are now combined in a housing 3 to form a unit which is a so-called "marker" 14. In addition to an antenna, this marker 14 is provided with one or more attaching devices 12 which "attach" it to the target—for example, by permanent magnets—through the use of an acceleration device 13. This device 13 is known in different embodiments. Thus, it may consist of two spring assemblies or pyrotechnical propelling charges which are activated in the case of a positive target identification and which, depending on the position of the marker 14, are selected by a mercury change-over switch, triggered by the trigger unit and thrown toward the target.

c) For communicating with the guided missile 5, the missile 5 is equipped with a direction finder 4 which is tuned to the transmitting frequency and the modulation process of the marker transmitter 2. Here, the antenna arrangement is such that the source of the received signal can be located. Several possibilities exist for this purpose, such as the arrangement of three so-called "squinting" antennas which are situated at an acute angle with respect to one another and permit the location of the "source" from a comparison of the respective received signal amplitudes (see FIG. 4).

d) Finally, the guided missile system 5 itself is a component of the end phase guidance described here which receives the direction finder 4 and is conceived such that a target is to be combatted within the limits given by the direction finding and guiding precision. The output signals of the direction finder 4 carried by the missile are used for the target precision approach and for the homing. In this case, the effective radius of the guided missile combat head must be at least as large as the average hitting error of the system, this error being derived essentially from the direction finding accuracy of the direction finder 4.

The operating sequence of the above-described system is such that, in the area to be blocked off—for example, by means of vehicle-supported or airplane-supported dispensers—large quantities of markers 14 are placed or dropped. If combat vehicles now traverse the area blocked off in this manner, they drive over or reach the proximity of the placed markers 14 which in the process are activated by the signature (acoustic, thermal or magnetic) of the vehicles; then automatically attach themselves to the vehicles and start to transmit. When the first marker signals are received at the control station of the guided missile system, which, for this purpose, is equipped with a separate direction finder having a higher sensitivity, the autonomous guided missiles 5 are started in a relatively rough alignment with the target. The direction finders 4 of the missile receive the locating signals emitted by the markers and supply corresponding coordinates to the guiding computers of the guided missiles 5 and steer them into the target.

Figure 2:
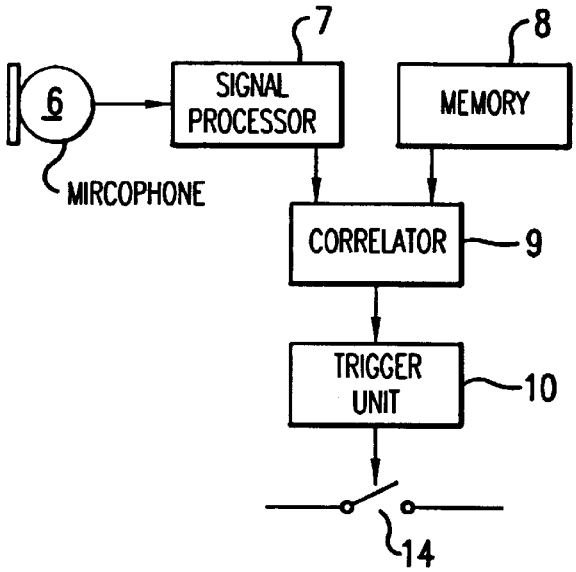
FIG. 2 is a schematic block diagram of an embodiment of an acoustic sensor.
Figure 3:
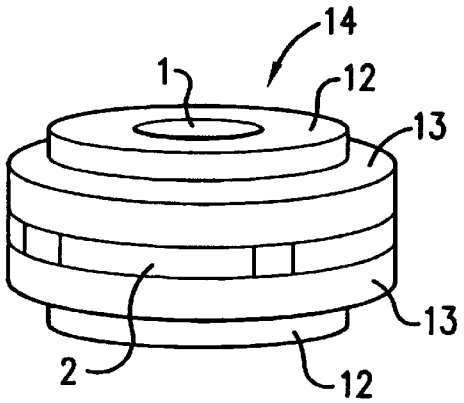
FIG. 3 is a perspective representation of an embodiment according to FIG. 1.

For achieving the object of the invention, in many cases a so-called "acoustic sensor" was found to be particularly advantageous. Embodiments of the state of the art can be used here which must be subjected to only relatively slight modifications. FIG. 2 is a block diagram of such a sensor which is composed of a microphone 6, a signal processing unit 7, a permanent memory 8, a correlator 9 and a trigger unit 10. The signal processing unit 7 extracts characteristics of the receiving signal such as the frequency spectrum, the amplitude distribution as well as the time history of operating sounds. In the permanent memory unit 8, characteristic definitions of the characteristics are stored which can be determined by the signal processing unit 7. The correlator 9 compares the analysis results of the signal processing unit and determines the respective conformity, while, in the case of a given conformity, the trigger unit 10 activates the marker 14. It should be noted that acoustic sensors of the above-described type can be constructed in a very small size because all electronic functions of the components 7 to 10 can be combined into one integrated circuit and the microphone 6 can also be manufactured in a micromechanical construction.

In order to largely avoid having two or more of the approaching missiles receive the same signal from a target, different codes are emitted, for example, by the marker transmitters and—purely statistically—the guided missiles are set to different codes. This considerably reduces the probability of a double impact, but does not reduce it to zero.

In addition, the placing of submunition or bomblets from the approaching guided missile (for example, Medium Artillery Rocket System or Long Artillery Rocket System type artillery rocket) is expedient. The direction finder of a submunition selects that transmitter code as the target which occurs with the highest level; thus, as a rule, the closest target. Since more remote targets cannot be reached by bomblets anyhow, this concept can be used successfully although multiple hits may also occur here.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A system for guiding an end-phase of autonomous long-range guided missiles, the system comprising:

at least one marker emitter arranged in an area to be blocked-off, said marker emitter including at least one signature sensor which is activated only by a target to be combatted, a position transmitter having an antenna arrangement to emit first continuous radio signals, an acceleration device for moving said marker emitter toward the target, and an attaching device for attaching said marker emitter to the target;

at least one guided missile having a direction finder arranged therein;

wherein said at least one signature sensor of said marker emitter is activated only by the target to be combatted;

wherein said first continuous radio signals of said position transmitter start the guided missile toward the target in a rough alignment, and wherein simultaneously said marker emitter moves toward the target via the acceleration device and attaches to the target via the attaching device; and wherein said marker emitter maintains radio communication with the direction finder of the guided missile until the target is struck.

2. The system according to claim 1, wherein said marker emitter is provided with several different signature sensors, said signatures of said signature sensors being used individually or in combination with one another.

3. The system according to claim 2, wherein said several different signature sensors are formed of commercially available magnetic-field sensors, temperature sensors, or acoustic sensors, or any combination thereof.

4. The system according to claim 1, wherein said at least one signature sensor is one of a commercially available magnetic-field sensor, temperature sensor, and acoustic sensor.

5. The system according to claim 1, wherein said direction finder includes an antenna composed of three individual antennas arranged at acute angles with respect to one another.

6. The system according to claim 1, wherein said attaching device is a permanent magnet.

7. The system according to claim 1, wherein said acceleration device is a pyrotechnic propellant.

8. A method for guiding an end-phase of long-range guided missiles which use target signatures of a marker emitter for target recognition and missile guidance, components of the target recognition and the missile guidance being separate from one another as a transmitter at a target and a receiver at a missile, the method comprising the steps of:

arranging a large quantity of said marker emitters in an area to be blocked-off, each of said marker emitters carrying at least one signature sensor which is activated only by a target to be combatted;

transmitting first continuous radio signals from a position transmitter arranged in each of said marker emitters in order to start guided missiles toward the target in a rough alignment; and simultaneously moving said marker emitters toward the target via an acceleration device and locking on said target via an attaching device;

wherein radio communication is maintained between said marker emitter and a direction finder of said guided missiles until the target is struck.

* * * * *